US006518208B2

(12) United States Patent
Terakawa

(10) Patent No.: US 6,518,208 B2
(45) Date of Patent: Feb. 11, 2003

(54) CONTINUOUS FIBER NONWOVEN AND THE METHOD FOR PRODUCING IT

(75) Inventor: Taiju Terakawa, Yasa-gun (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 10/119,156

(22) Filed: Apr. 10, 2002

(65) Prior Publication Data

US 2002/0182405 A1 Dec. 5, 2002

Related U.S. Application Data

(63) Continuation of application No. 08/657,303, filed on Jun. 3, 1996, now abandoned.

(30) Foreign Application Priority Data

Jun. 6, 1995 (JP) ..... 7-164749

(51) Int. Cl.[7] ..... D01F 8/00; D01D 5/00; D01D 5/12; D04H 1/00

(52) U.S. Cl. ..... 442/327; 442/335; 428/370; 428/373; 428/362; 428/369; 264/103; 264/168; 264/172.14; 264/172.15

(58) Field of Search ..... 442/327, 335; 428/370, 373, 369, 374, 362, 377; 264/103, 168, 172.14, 172.15, 210.8, 211.17

(56) References Cited

U.S. PATENT DOCUMENTS

| | | | | |
|---|---|---|---|---|
| 4,315,881 | A | 2/1982 | Nakajima et al. | 428/374 |
| 5,344,707 | A | 9/1994 | Snyder | 428/373 |
| 5,382,400 | A | 1/1995 | Pike et al. | 428/373 |
| 5,418,045 | A | 5/1995 | Pike et al. | 428/374 |
| 5,800,230 | A | 9/1998 | Horiuchi et al. | 442/352 |
| 5,895,710 | A | 4/1999 | Sasse et al. | 442/335 |
| 6,159,881 | A | 12/2000 | Datta et al. | 442/409 |

FOREIGN PATENT DOCUMENTS

| | | |
|---|---|---|
| JP | 45-1649 | 1/1970 |
| JP | 48-1471 | 1/1971 |
| JP | 63-282350 | 11/1988 |
| JP | 5-209354 | 8/1993 |

*Primary Examiner*—N. Edwards
(74) *Attorney, Agent, or Firm*—Wenderoth, Lind & Ponack, L.L.P.

(57) ABSTRACT

A continuous fiber nonwoven comprising composite continuous fibers having the spiral crimps obtained by compositely spinning two thermoplastic resins having the difference in the melting points of 15° C. or more is provided, and it is characterized in that the contact points of the fibers are adhered one another by fusing of the thermoplastic resin having a low melting point and located on the outside of the spiral crimps.

12 Claims, No Drawings

CONTINUOUS FIBER NONWOVEN AND THE METHOD FOR PRODUCING IT

This is a continuation of Ser. No. 08/657,303 filed Jun. 3, 1996 now abandoned.

BACKGROUND OF THE INVENTION

1. Field of the Invention

The present invention relates to a continuous fiber nonwoven produced by heat fusion and having excellent bulkiness and high tensile strength. More concretely, it provides a continuous fiber nonwoven used for sanitary materials, engineering materials, agricultural materials, packing materials and the like.

2. Description of the Prior Art

In methods for producing nonwovens utilizing characteristics of heat fusion, there are a heat treating method of card webs comprising staple fibers and a heat treating method of continuous fiber webs. Although the latter method has an advantage that the production process is simple, the resulting nonwoven has the fault of low flexibility and low bulkiness.

Conventional continuous fiber nonwovens, which are produced by a method of heat fusion and used for sanitary materials, engineering materials and the like, are mainly made of fibers of one component, since such fibers do not develop crimps, they have low bulkiness.

As known methods for developing the steric crimps of a spiral form (abbreviated as spiral crimps, hereinafter) in the fibers of one component, there are a method for developing the spiral crimps based on the difference of heat shrinkage inside the fiber by pulling out the spun fiber while partial quench is applied to the fiber (Japanese Patent Publication No. 45-1649), and a method for developing the crimps based on the difference of degree of crystallization by blending a nucleating agent into a certain part of the fiber cross-section (Japanese Patent Application Laid-open No. 5-209354). In the former method, however, the crimps are loosened through the heat treatment process for processing the fiber into a nonwoven and the bulkiness becomes insufficient. In both methods, since the fiber is constituted from one component, a hot pressing method is only used as the heat treatment process for processing the fiber to the nonwoven, so that the spiral crimps of the fiber is pressed resulting undesirable bulkiness.

It is known that the spiral crimps are developed in the fiber by compositely spinning several thermoplastic resins into a parallel or eccentric sheath core type arrangement (Japanese Patent Application Laid-open Nos. 48-1471 and 63-282350). In the nonwovens using these composite fibers, however, although it was recognized that the bulkiness was improved, the tensile strength was the same as (or less than) that of conventional nonwovens of one component fibers, so that more improvement has been desired.

The present invention provides a continuous fiber nonwoven having excellent bulkiness and high tensile strength in view of the above conditions of the continuous fiber nonwovens produced by heat fusion methods.

SUMMARY OF THE INVENTION

The inventor of the present invention has earnestly studied to solve the above problems by aiming at the relation between the spiral crimps developed in the composite fibers and the arrangement of components on the fiber cross-section. As a result, he has had knowledge that these aims are attained by using composite fibers comprising several thermoplastic resins arranged in a parallel or eccentric sheath core type, in which the thermoplastic resins having a low melting point is located on the outside of the spiral crimps developed by stretching the fibers, and he has completed the present invention.

Namely, the first invention of the present application provides a continuous fiber nonwoven comprising composite continuous fibers having the spiral crimp obtained by compositely spinning two kinds of thermoplastic resins having difference in melting point of 15° C. or more, characterized in that the contact points of the fibers are adhered one another by fusing the thermoplastic resin having a low melting point and located on the outside of the spiral crimps.

The second invention of the present application provides a method for producing a continuous fiber nonwoven comprising: preparing the first thermoplastic resin and the second thermoplastic resin having a melting point 15° C. less than that of the first thermoplastic resin and an elastic shrinkage 1% less than that of the first thermoplastic resin; compositely spinning these resins in a composite ratio of 60/40–40/60 into a parallel type or an eccentric sheath core type, in which the second thermoplastic resin is a sheath and the first thermoplastic resin is a core eccentric to the sheath; stretching the resulting yarn over 1.2 times as long as the unstretched yarn at a temperature lower than the melting point of the second thermoplastic resin; and heat treating the yarn at a temperature higher than the melting point of the second thermoplastic resin and lower than the softening point of the first thermoplastic resin to adhere the contact points of the fibers.

DETAILED DESCRIPTION OF THE INVENTION

The present invention is particularly described in the following.

The thermoplastic resins used as raw materials of composite continuous fibers includes, for example, polyolefins such as polypropylene, polyethylene, ethylene-propylene copolymer, propylene-butene-1 copolymer, ethylene-propylene-butene-1 copolymer, ethylene-vinyl acetate copolymer, and poly-4-methylpentene-1, polyolefins modified with unsaturated carboxylic acids or their anhydride, polyesters such as polyethylene terephthalate, polyethylene terephthalate-isophthalate copolymer and polybutylene terephthalate, polyamides such as nylon 6, nylon 66 and nylon 12, thermoplastic polyurethane and the like.

In the present invention, combination of two kinds of thermoplastic resins having difference in melting point of 15° C. or more is selectively used. In this case, it is necessary to use spinning conditions that the elastic shrinkage of the thermoplastic resin having a high melting point becomes higher 1% or more than that of the thermoplastic resin having a low melting point.

In the present invention, nonwovens are obtained by heat treating the composite continuous fibers and adhering the contact points of fibers by fusing only thermoplastic resin having a low melting point. If the difference of melting points of two thermoplastic resins, which are raw materials of composite fibers, is less than 15° C., it is undesired because the temperature range usable in the heat treatment becomes narrow.

The term "elastic shrinkage" means a shrinkage that unstretched yarn of one component is stretched to the same draw ratio (K) as drawing conditions of the composite fibers and at once the load is removed, and the following equation is provided.

$$\text{Elastic shrinkage } S(\%)=100\times(KA-B)/(KA-A)$$

A: length of unstretched yarn

B: length of yarn at removal of load after stretching the yarn.

When it is impossible to spin one component fiber of thermoplastic resin (a), or it is impossible to stretch it to the length of 1.5 times, elastic shrinkage (S1) of the unstretched yarn composed of single component of thermoplastic resin (b) having excellent stretch properties, and elastic shrinkage (Sc) of the unstretched yarn composite fibers composed of thermoplastic resin (a) and thermoplastic resin (b), are measured, and the elastic shrink (S2) of the unstretched yarn of thermoplastic resin (a) is calculated by the following equation:

$$S2=2Sc-S1$$

When the difference of elastic shrinkages of two thermoplastic resins is less than 1%, distinct crimps are not observed after stretching the composite fibers, and it is unable to obtain sufficiently bulky nonwovens. In two thermoplastic resins, if the elastic shrink of the thermoplastic having a high melting point is less than that of the thermoplastic resin having a low melting point, it is impossible to locate the thermoplastic resin having a low melting point on the outside of the spiral crimps which are appeared after the composite fibers are stretched.

In the composite continuous fibers used in the present invention, two thermoplastic resins selected in accordance with the above standards are compositely spun into a parallel type or an eccentric sheath core type in the range of a composite ratio of 60/40–40/60. Since the crimps of the composite fibers are based on the difference between the elastic shrinks of both components, clear crimps are not appeared when one component is in less than 40%, so that sufficiently bulky nonwovens are not obtainable. In case of the eccentric sheath core type, thermoplastic having a low melting point is used at the sheath side of the composite fibers.

Crystalline polypropylene/polyethylene can be exemplified as desirable combination of two thermoplastic resins, and crystalline polypropylene having a wide molecular weight distribution can be desirably used as a thermoplastic resins having a high melting point, because it shows a relatively high elastic shrinkage.

After the unstretched yarn obtained by the composite spinning is stretched, and immediately, the stress is removed, the spiral crimps develop in the composite fibers. The curvature radius of the spiral is based on not only physical properties of the differences among the elastic shrinkages of the raw material resins, the Young's modulus, the fineness and the like, but also the stretching temperature and the draw ratio. The stretching conditions are selected in accordance with degree of bulkiness of desired nonwovens (commonly, 1.2–4 times of length of unstretched yarn, between room temperature and a temperature lower than the melting point of the second thermoplastic resin).

In such obtained composite continuous fibers, the thermoplastic resin having a low melting point is located on the outside of the spiral crimps.

To obtain the web of the composite continuous fibers having spiral crimps and used in the present invention, two thermoplastic resins selected in accordance with the said standards are compositely spun at the fixed composite ratio, and the unstretched yarn stored on bobbins or in canes are stretched under the fixed stretching conditions and immediately accumulated on a conveyer. It is also possible to use a spunbond method in which the spun composite fibers are pulled with a stretch machine equipping a feed roll and a draw roll via a quench device, and then accumulated on a conveyer net in which the fibers are suck with an air sucker and the fibers are opened.

The continuous fiber nonwoven of the present invention is obtained by heat treatment of the above composite continuous fiber webs having spiral crimps at a temperature higher than the melting point of the thermoplastic resin having the low melting point and lower than the softening point of the thermoplastic resin having a high melting point. In the heat treatment, a hot pressing device such as an embossing roll, or a suction dryer with internal air circulation, or a heater such as an infrared heating oven may be used.

Although the contact points of the fibers are adhered by heat treatment to fuse the thermoplastic resin having a low melting point, because the thermoplastic resin having a low melting point is located on the outside of the spiral crimps in the composite continuous fibers used in the present invention, the fibers contact one another by the thermoplastic resin having a low melting point, the fibers are adhered one another by fusion of the same kinds of thermoplastic resins, and nonwovens having a high tensile strength are obtained.

When a hot pressing device is used in the heat treatment, a temperature of the heat treatment may be a temperature near the softening point of the thermoplastic resin having a low melting point, which is located on the outside of the spiral crimps, so that the thermoplastic resin having a high melting point does not soften or change the shape by heat, and bulky and soft nonwovens can be obtained.

To obtain nonwovens having a sufficient strength by using the composite fibers in which thermoplastic resin having a low melting point is located on the inside of the spiral crimps, it is necessary to treat the fibers at higher temperature to soften the thermoplastic resin having a high melting point, so that the touch of the nonwoven becomes hard.

Since the suction dryer with internal air circulation can provide a sufficient heat capacity without pressing its continuous fiber web, it is preferably used for producing bulky nonwovens at a high speed. In this case, since the thermoplastic resin having a low melting point is located on the outside of the spiral crimps, the composite fibers contact one another with the thermoplastic resin having a low melting point to fix the fibers by fusing the same kind of thermoplastic resins, and nonwovens having a high tensile strength are obtained.

When the fibers are heated at a temperature to fuse the thermoplastic resin having a low melting point, the thermoplastic resin having a high melting point slightly shrinks to reduce the strain produced by stretching the fibers, while the thermoplastic resin having a low melting point greatly shrinks and fuses, and in result, the spiral crimps reversely turn so as to arrange the thermoplastic resin having a high melting point outside of the spiral crimps of the composite fibers. By such fibers, the numbers of contact and adhered points among the fibers are increased to obtain nonwovens having a high strength. Further, since the fibers pull one another between the adhered points, the bulkiness is little decreased.

When the composite fibers, in which the thermoplastic resin having a low melting point is arranged inside of the spiral crimps, are heat treated with a suction dryer, the spiral crimps of the composite fibers become smaller by the shrink and the fuse of the thermoplastic resin having a low melting point, the bulkiness of the nonwoven is lost, and the strength of the nonwoven decreases with the decrease of the adhered points among the thermoplastic resins having a low melting point.

Since the continuous fiber nonwoven of the present invention is obtained by using the composite continuous fibers as raw fiber materials in which the thermoplastic resin having a low melting point are located on the outside of the spiral crimps, it has the same or higher degree of tensile strength in comparison with conventional nonwovens of continuous fibers, and it has high bulkiness which is not observed in the conventional nonwovens. Accordingly, it is possible to preferably use the nonwovens of the present invention as sanitary materials for surface materials of diapers and the like, geotextile, packaging materials, etc.

DESCRIPTION OF THE PREFERRED EMBODIMENTS

The present invention is illustrated more specifically by the following examples and comparative examples. The physical values in these examples are determined by the following methods.

Elastic Shrinkage:

A unstretched yarn of one component fibers and a unstretched yarn of composite fibers are stretched at a grip distance of 10 cm and a stretching rate of 10 cm/min to the same magnification (K) in examples and comparative examples, and these yarns are immediately returned to the beginning grip distance, and the fiber length (c) of a zero point of the stretching load is measured and then the elastic shrinkage (S) is calculated by the following equation.

$$\text{Elastic shrinkage } S\ (\%)=100\times(10\ K-c)/(10\ K-10)$$

$$S2=2Sc-S1$$

Arrangement of components of spiral crimps:

A specimen having one cycle length of the spiral crimps is cut off from the composite fibers, it is put between two pieces of cover glass to form a circle, and observing the melting behavior of the thermoplastic resin having a low melting point by using an optical microscope equipping a hot stage, arrangement of components is identified.

Number of Crimps:

A fiber having ten spiral crimps is cut off and the straight length L (cm) is measured and the number of crimps is calculated by the following equation:

$$\text{Number of crimps (crimps/inch)}=10\times2.54/L$$

Specific volume of nonwoven:

Four test pieces having 10 cm length and 10 cm width are piled, a plate having the same length and width and 20 g weight is put on the test pieces, the thickness D (cm) of the four test pieces is measured, the total weight W1 (g) of the four test pieces is previously measured, and the specific volume of nonwoven is calculated by the following equation:

$$\text{Specific volume of nonwoven } (cm^3/g)=100\times D/W1$$

Tensile Strength of Nonwoven:

Test pieces having 20 cm length and 5 cm width (weight is W2) are cut off from nonwoven in a machine direction of nonwoven production (MD) and its cross direction (CD), maximum load power P (g) is measured at a grip distance of 10 cm and a stretching rate of 10 cm/min, and the tensile strength is calculated by the following equation after $gr/m^2$ is corrected:

$$\text{Tensile strength } (g/(cm\times g/m^2))=P/500W2$$

$$\text{Geometric mean strength}=(\text{MD strength}\times\text{CD strength})^{1/2}$$

EXAMPLES 1–5 AND COMPARATIVE EXAMPLES 1–4

Table 1 shows production conditions of raw continuous fibers and properties of the continuous fibers used for nonwovens of Examples and comparative examples.

TABLE 1

| | Spinning and stretching conditions | | | | | | | | Properties of fibers | | | |
|---|---|---|---|---|---|---|---|---|---|---|---|---|
| | Fiber components Type | Temp. of extruder ° C. | Spinneret temp. ° C. | Elastic shrinkage % | Difference of elastic shrinkage % | Fineness d | Stretch temp. ° C. | Stretch ratio | Arrangement outside/inside | Number of crimps | Yarn strength g/d | Yarn elongation % |
| Example 1 | HDPE | 240 | 280 | 25.2 | 2.6 | 2.0 | room temp. | 2.0 | HDPE | 6.5 | 2.43 | 169 |
| | Parallel | | | | | | | | | | | |
| | PP1 | 290 | | 27.8 | | | | | PP1 | | | |

TABLE 1-continued

| | Spinning and stretching conditions | | | | | | | | Properties of fibers | | | |
|---|---|---|---|---|---|---|---|---|---|---|---|---|
| | Fiber components Type | Temp. of extruder ° C. | Spinneret temp. ° C. | Elastic shrinkage % | Difference of elastic shrinkage % | Fineness d | Stretch temp. ° C. | Stretch ratio | Arrangement outside/inside | Number of crimps | Yarn strength g/d | Yarn elongation % |
| Example 2 | HDPE Parallel | 240 | 280 | 25.2 | 7.0 | 2.0 | room temp. | 2.0 | HDPE | 12.0 | 2.25 | 180 |
| | PP2 | 290 | | 32.2 | | | | | PP2 | | | |
| Example 3 | HDPE eccentric sheath core | 240 | 280 | 25.2 | 7.0 | 2.0 | room temp. | 2.0 | HDPE | 9.5 | 2.12 | 195 |
| | PP2 | 310 | | 32.2 | | | | | PP2 | | | |
| Example 4 | HDPE eccentric sheath core | 240 | 280 | 27.5 | 9.2 | 2.0 | room temp. | 1.7 | HDPE | 11.0 | 1.88 | 224 |
| | PP2 | 310 | | 36.7 | | | | | PP2 | | | |
| Comparative example 1 | PP1 only one | 290 | 260 | 27.8 | — | 2.0 | room temp. | 2.0 | — | 0 | 2.71 | 1.36 |
| Comparative example 2 | HDPE Parallel | 240 | 280 | 25.2 | 0.8 | 2.0 | — | — | PP1 | 7.8 | 1.38 | 275 |
| | PP2 | 290 | | 26.0 | | | | | HDPE | | | |
| Comparative example 3 | HDPE Parallel | 240 | 280 | 25.2 | 0.8 | 2.0 | room temp. | 2.0 | Developing poor crips | 2.0 | 1.98 | 206 |
| | PP2 | 340 | | 26.0 | | | | | | | | |

Note:
PP1 = Crystalline polypropylene, MFR = 10, Q = 3.5, m.p. = 164° C., s.p. = 144° C.
PP3 = Crystalline polypropylene, MFR = 25, Q = 5.0, m.p. = 164° C., s.p. = 143° C.
HDPE = High-density polyethylene, MFR = 40, m.p. = 129° C., s.p. = 100° C.

Fibers of Examples 1–3, which were obtained by combining crystalline polypropylene and high-density polyethylene, compositely spinning them, and stretching the yarn, have developed desirable spiral crimps arranging 5 high-density polyethylene outside the spiral crimps. In Example 2, composite fiber having many crimps is obtained by the same conditions of spinning and stretching as in Example 1. It is considered that the fact is caused by using crystalline polypropylene having wide molecular 10 weight distribution (high Q value).

Although the composite fiber, which was obtained in Example 3 by using the same raw materials, spinning temperature and stretch conditions as in Example 2, develops desirable spiral crimps arranging high-density polyethylene, the number of crimps has been less by changing the composite type to an eccentric sheath core type. However, by changing the stretch conditions, it was able to obtain the composite fiber of the eccentric sheath core type having many crimps (Example 4).

The fiber comprising one component of crystalline polypropylene (Comparative example 1) does not develop the spiral crimps even though the fiber was stretched as in Example 1.

In Comparative example 2, in which the fiber was extruded by using the same conditions as in Example 1 and directly spun with air-sucker instead of machine stretching, the fiber developed spiral crimps, inside of which high-density polyethylene, the component having a low melting point, was arranged.

In Comparative example 3, in which the composite fiber was obtained by spinning and stretching the yarn as the same process as in Example 1 except that the extrusion temperature of crystalline polypropylene was increased. The difference of elastic shrinkages became smaller and very poor spiral crimps were developed.

The webs of various continuous fibers were processed by heat treatment with a heat oven with internal air circulation or a heat embossing roll to obtain nonwovens. The process conditions and the physical properties of the nonwovens are shown in Table 2.

TABLE 2

| | Processing conditions | | Physical properties of nonwoven | | | |
|---|---|---|---|---|---|---|
| | Air circulation oven temperature Treating time | Emboss. temp. Emboss. area | Basis weight g/m$^2$ | Thickness mm | Specific volume cm$^3$/g | Geometric mean strength (*) |
| Example 1 | 135° C. | — | 30 | 1.19 | 39.8 | 26.3 |
| | 1.7 sec. | — | | | | |
| Example 2-1 | 135° C. | — | 30 | 1.46 | 48.8 | 26.0 |
| | 1.7 sec. | — | | | | |

TABLE 2-continued

| | Processing conditions | | Physical properties of nonwoven | | | |
|---|---|---|---|---|---|---|
| | Air circulation oven temperature Treating time | Emboss. temp. Emboss. area | Basis weight g/m$^2$ | Thickness mm | Specific volume cm$^3$/g | Geometric mean strength (*) |
| Example 2-2 | — | 125° C. 15% | 30 | 0.70 | 23.3 | 28.0 |
| Example 3 | 135° C. 1.7 sec. | — — | 30 | 1.37 | 45.6 | 27.3 |
| Example 4 | 135° C. 1.7 sec. | — — | 30 | 1.40 | 46.5 | 24.8 |
| Comparative example 1 | — — | 145° C. 15% | 31 | 0.26 | 8.5 | 30.0 |
| Comparative example 2-1 | 135° C. 1.7 sec. | — — | 31 | 0.94 | 30.3 | 12.2 |
| Comparative example 2-2 | — — | 125° C. 15% | 30 | 0.51 | 17.0 | 15.5 |
| Comparative example 3 | 135° C. 1.7 sec. | — — | 30 | 0.46 | 15.2 | 25.4 |

(*): g/(cm · g/m$^2$)

The nonwoven comprising one component fiber of crystalline polypropylene obtained in Comparative example 1 is poorer in the bulkiness and strength than those of the other examples.

The nonwoven prepared in Comparative examples 2-1 by using the same raw materials and process conditions as in Example 1 is poor in the bulkiness (thickness and specific volume) and strength in comparison with the nonwoven in Example 1. It is considered that the fact is caused by arranging crystalline polypropylene having elastic shrinkage outside of the spiral crimps, and by arranging high-density polyethylene having adhesion properties inside of the spiral crimps.

The nonwoven prepared by a heat embossing roll in Example 2-2 is poor in the bulkiness, but it is good in the strength in comparison with the nonwoven obtained in Example 2-1. The nonwoven of Example 2-2 is good in both the bulkiness and the strength in comparison with the nonwoven prepared by the heat embossing roll in Comparison example 2-2.

Although the raw materials are different from those in Example 1, the nonwovens of Examples 3 and 4, in which the difference of the elastic shrinkage and the constitution of the spiral crimps satisfy the requirements of the present invention, show better properties than those of the nonwoven of Example 1. Compared with the nonwovens of Examples, the nonwoven of Comparative example 3, which does not satisfy the above requirements of the present invention, is poor in both the bulkiness and the strength.

What is claimed is:

1. A nonwoven material comprising composite continuous fibers having spiral crimps and produced by a process comprising:

selecting a first thermoplastic resin and a second thermoplastic resin, the second resin having a melting point of at least 15° C. less than the first resin, compositely spinning the first and second resins into fibers having a side-by-side arrangement or an eccentric sheath core arrangement in which the second resin is a sheath and the first resin is a core eccentric to the sheath, wherein the ratio of the first resin to the second resin in the fibers is between 40:60 and 60:40, and wherein the elastic shrinkage % of the first resin is 1% or more higher than the elastic shrinkage % of the second resin in the fibers, to obtain a yarn, stretching the yarn over 1.2 times as long as the unstretched yarn at a temperature between room temperature and lower than the melting point of the second resin, and then relaxing the yarn, to form spiral crimps in the fibers of the yarn, said spiral crimps being formed when the yarn is relaxed based upon the difference in elastic shrinkage % between the first and second resins, forming a nonwoven material from the stretched yarn, and heat treating the nonwoven material at a temperature higher than the melting point of the second resin and lower than the softening point of the first resin to adhere the fibers of the yarn together at the contact points of the fibers, wherein the contact points of the fibers are adhered to one another by fusing of the second resin having a low melting point located on the outside of the spiral crimps.

2. The nonwoven material according to claim 1, wherein the first resin is a crystalline polypropylene and the second resin is a high density polyethylene.

3. The nonwoven material according to claim 1, wherein the nonwoven material has a specific volume of 39.8 cm$^3$/g or greater.

4. The nonwoven material according to claim 1, wherein the heat treatment is conducted by a system of an oven with internal air circulation.

5. The nonwoven material according to claim 1, wherein the heat treatment is conducted by a hot pressing system.

6. The nonwoven material according to claim 1, wherein the yarn is stretched between 1.2 to 4 times the length of the unstretched yarn.

7. A method for producing a nonwoven material comprising composite continuous fibers having spiral crimps according to claim 1, said method comprising the steps of:

selecting a first thermoplastic resin and a second thermoplastic resin, the second resin having a melting point of at least 15° C. less than the first resin, compositely spinning the first and second resins into fibers having a side-by-side arrangement or an eccentric sheath core arrangement in which the second resin is a sheath and the first resin is a core eccentric to the sheath, wherein the ratio of the first resin to the second resin in the fibers is between 40:60 and 60:40, and wherein the elastic shrinkage % of the first resin is 1% or more higher than the elastic shrinkage % of the second resin in the fibers, to obtain a yarn, stretching the yarn over 1.2 times as long as the unstretched yarn at a temperature between room temperature and lower than the melting point of the second resin, and then relaxing the yarn, to form spiral crimps in the fibers of the yarn, said spiral crimps being formed when the yarn is relaxed based upon the difference in elastic shrinkage % between the first and second resins, forming a nonwoven material from the stretched yarn, and heat treating the nonwoven material at a temperature higher than the melting point of the second resin and lower than the softening point of the first resin to adhere the fibers of the yarn together at the contact points of the fibers, wherein the contact points of the fibers are adhered to one another by fusing of the second resin having a low melting point located on the outside of the spiral crimps.

8. The method according to claim 7, wherein the first resin is a crystalline polypropylene and the second resin is a high density polyethylene.

9. The method according to claim 7, wherein the nonwoven material has a specific volume of 39.8 $cm^3/g$ or greater.

10. The method according to claim 7, wherein the heat treatment is conducted by a system of an oven with internal air circulation.

11. The method according to claim 7, wherein the heat treatment is conducted by a hot pressing system.

12. The method according to claim 7, wherein the yarn is stretched between 1.2 to 4 times the length of the unstretched yarn.

* * * * *